United States Patent [19]

Kawamura et al.

[11] Patent Number: 4,967,425

[45] Date of Patent: Nov. 6, 1990

[54] SANITARY EQUIPMENT FOR CLEAN ROOM

[75] Inventors: Seijiro Kawamura, Fukuoka; Masami Iida, Kanagawa; Akio Kusumoto, Fukuoka; Takao Ikenaga, Kanagawa; Toshifumi Shigematsu, Kanagawa; Hiroshi Okada, Fukuoka, all of Japan

[73] Assignee: Toto, Ltd., Fukuoka, Japan

[21] Appl. No.: 334,905

[22] Filed: Apr. 10, 1989

Related U.S. Application Data

[63] Continuation of Ser. No. 783,553, Oct. 3, 1985, abandoned.

[30] Foreign Application Priority Data

Oct. 12, 1984 [JP] Japan ..... 59-153953
Oct. 25, 1984 [JP] Japan ..... 59-161843
Oct. 25, 1984 [JP] Japan ..... 59-161844

[51] Int. Cl.[5] ..... A47K 1/04

[52] U.S. Cl. ..... 4/619; 4/623; 4/638; 4/643

[58] Field of Search ..... 4/252 R, 619, 623, 624, 4/638, 646, 648, DIG. 5, 591, 662

[56] References Cited

U.S. PATENT DOCUMENTS 2,004,933 6/1935 Davison ..... 4/300 X
2,094,840 10/1937 Groeniger et al. ..... 4/619
2,738,448 3/1956 Bokser .
3,129,437 4/1964 McClenahan .
3,273,173 9/1966 Morris et al. .
3,576,038 4/1971 Dirks .
3,576,277 4/1971 Blackmon .
4,086,668 5/1978 Tubbs .
4,144,596 3/1979 MacFarlane et al. .
4,295,233 10/1981 Hinkel et al. .
4,692,951 9/1987 Taki et al. .
5,149,346 9/1964 Springer .

FOREIGN PATENT DOCUMENTS 0177967 4/1986 European Pat. Off. .
779757 4/1935 France ..... 4/591
2039930 1/1971 France .
80/01983 10/1980 PCT Int'l Appl. .
860747 2/1961 United Kingdom .
1203583 8/1970 United Kingdom .

OTHER PUBLICATIONS

Copy of European Search Report.

*Primary Examiner*—Charles E. Phillips
*Attorney, Agent, or Firm*—Sandler, Greenblum & Bernstein

[57] ABSTRACT

The present invention relates to a sanitary equipment which is provided in a toilet attached to a clean room. The side surface of the body of the sanitary equipment is made almost vertical, and fixation elements for fastening the body of the equipment onto the wall of the toilet do not protrude into the toilet. As a result, air is circulated through the toilet in such a manner that the air flowing down in the toilet is not disturbed.

8 Claims, 8 Drawing Sheets

SANITARY EQUIPMENT FOR CLEAN ROOM

This is a continuation of application Ser. No. 06/783,553 filed Oct. 3, 1985 now abandoned.

SCOPE OF THE INVENTION

The present invention relates to a sanitary equipment for a clean room, which is provided in a toilet sttached to the clean room in an integrated circuit production plant, a food production or processing plant or the like.

DESCRIPTION OF THE PRIOR ART

In a conventional toilet attached to a clean room, a grating, a punched metal plate or the like is laid on the floor of the toilet to provide numerous air discharge ports. The air in the toilet is sucked out of it through the air discharge ports by a fan installed outside the toilet and is returned into the toilet through an air filter mounted on the ceiling of the toilet, so that dust or the like should not stay or accumulate in the toilet. The dust or the like might thus be prevented from being carried into the clean room. However, since a toilet stool, for example, provided as a sanitary equipment in the toilet has a recess on the side surface of the lower part of the toilet stool and is fixed at the bottom on the floor of the toilet by bolts or the like, the circulating air flowing down in the toilet is disturbed around the toilet stool so that an air flow stays near said recess. If the staying air flow contains dust or the like, the dust or the like is likely to stay and cling to the clothes of the user of the toilet so that the dust or the like is carried into the clean room. If a toilet bowl for urine or a washstand is provided, in stead of the toilet stool, in the toilet, the circulating air flowing down in the toilet is disturbed because the toilet bowl or the washstand projects from the wall of the toilet, so that an air flow stays in the toilet. If the staying air flow contains dust or the like, the dust or the like is likely to stay and accumulate on the top of the toilet bowl or the washstand in particular, fly off again and cling to the clothes of the user of the toilet so that the dust or the like is carried into the clean room.

In addition, since a water feeder is manually handled for each of the above-mentioned sanitary equipments to supply washing water to the pot-shaped portion of the equipment, dirt from the hand of the user is likely to cling to the handling portion of the water feeder, fly off in the form of particles from the handling portion, float in the air and cling to the clothes or the like of the user so that the particles are carried into the clean room.

SUMMARY OF THE INVENTION

The first purpose of the present invention is to provide a sanitary equipment for a clean room, which does not cuase dust or the like to stay in a chamber furnished with the equipment.

The second purpose of the present invention is to provide a sanitary equipment for a clean room, which enables the user of the equipment to supply washing water without putting a hand into contact with the equipment.

The first purpose of the present invention is attained by making the side surface of the body of the sanitary equipment almost vertical and by furnishing fixation elements for fastening the body of the equipment onto a wall, so that the fixation elements do not project into the chamber furnished with the equipment.

The second purposed of the present invention is attained by furnishing a sensor to open and close a water feeder for supplying the washing water to the body of the equipment.

BRIEF DESCRIPTION OF THE DRAWINGS

Other purposes and features of the present invention are clarified in the following description with reference to the drawings.

DETAILED DESCRIPTION OF PREFERRED EMBODIMENTS

Figure 1:
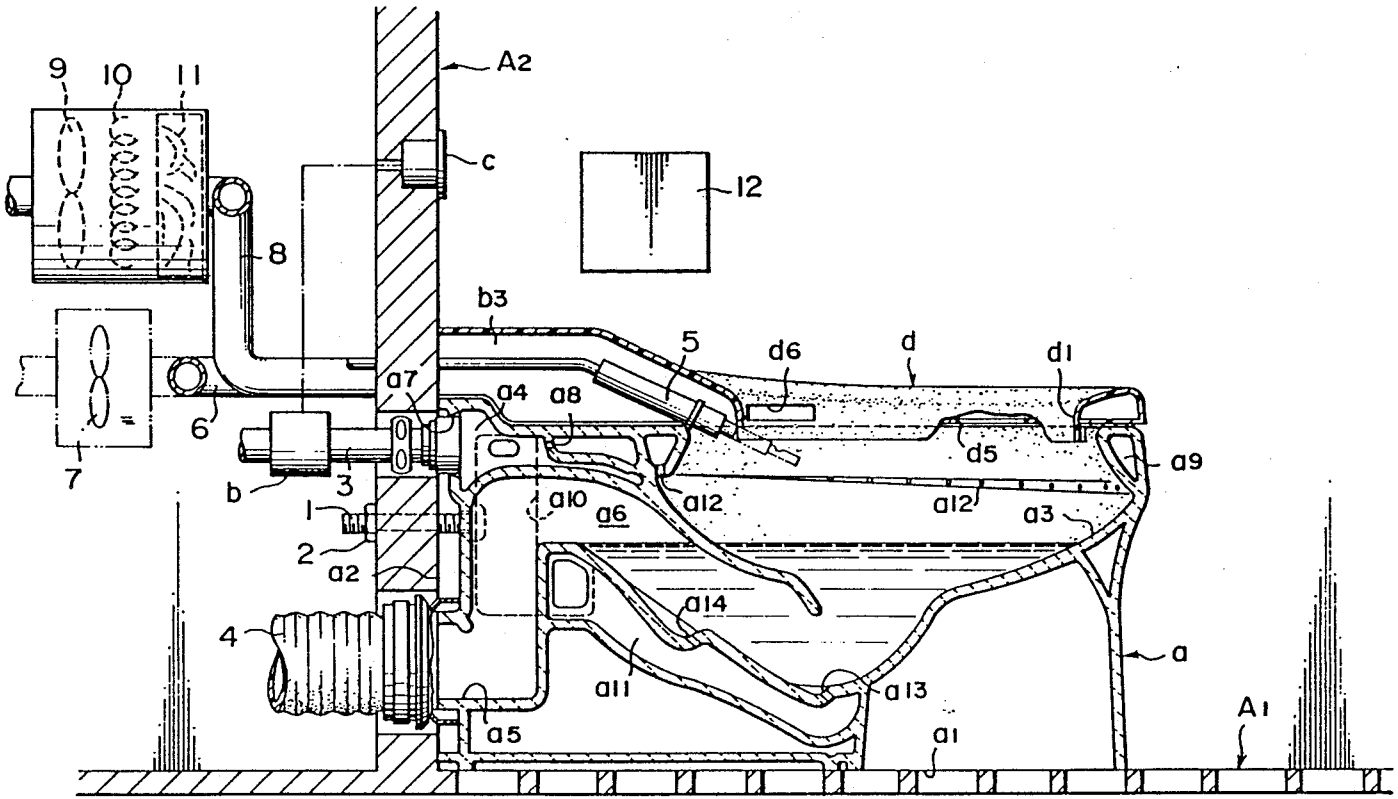
FIG. 1 shows a longitudinal sectional side view of a sanitary equipment for a clean room, which is an embodiment of the present invention and whose body is a toilet stool.
Figure 2:
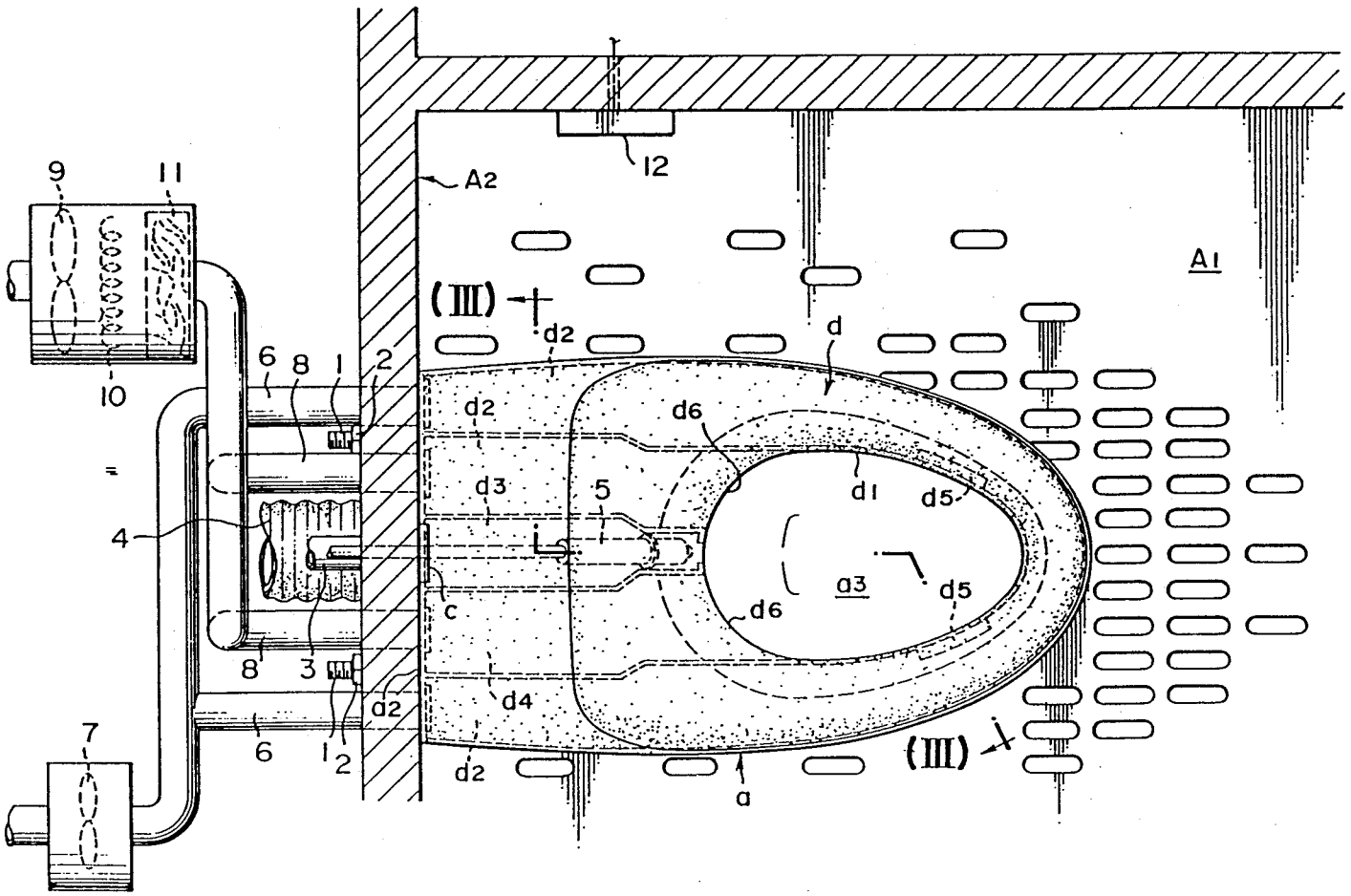
FIG. 2 shows a plan view of the sanitary equipment.
Figure 3:
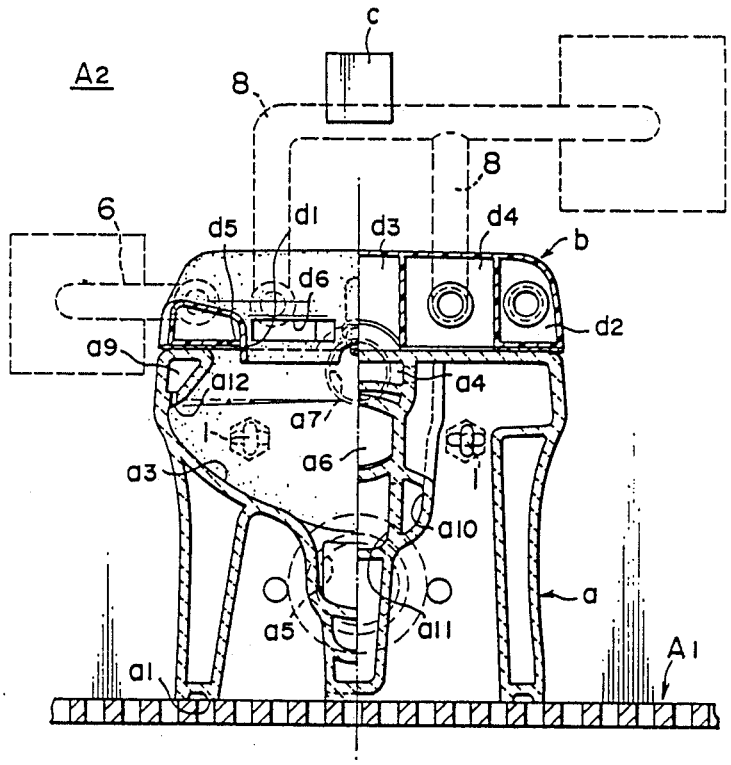
FIG. 3 shows a sectional view of the sanitary equipment along a line III—III shown in FIG. 2.
Figure 4:
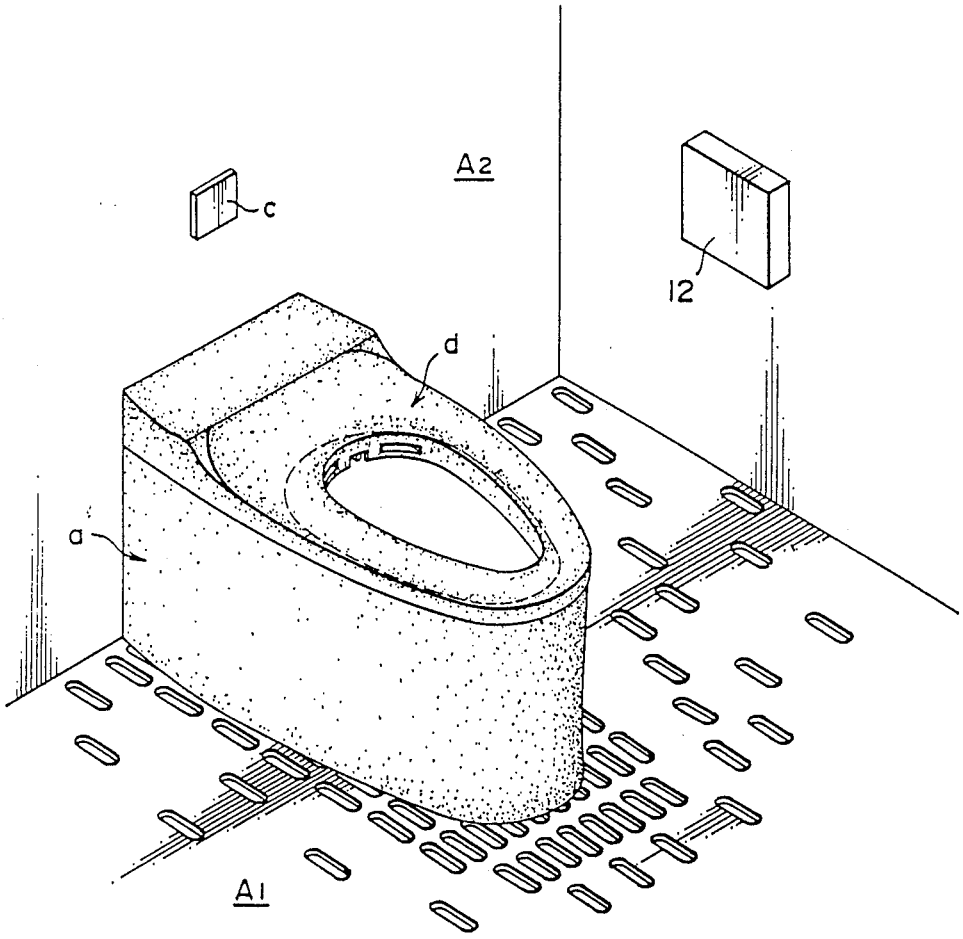
FIG. 4 shows an oblique view of the sanitary equipment.

The embodiment shown in FIG. 1, 2, 3 and 4 is hereinafter described. The body (a) of the sanitary equipment shown in these four drawing is a toilet stool of the blowout type. The body (a) is made of ceramic or synthetic resin so that the side surface of the body is made almost vertical and does not have a large recess or protrusion though the side surface may have a small recess or protrusion or may be slightly oblique. The bottom a1 of the body (a) is placed on the floor A1 of a toilet as shown in the drawings, the floor A1 is provided with openings, i.e., either in the form of a grate or as a punched metal plate, so as to provide numerous air discharge ports in the floor to ensure circulation of the air through the chamber. The rear a2 of the body (a) is put in tight contact with the wall A2 of the toilet. Fixation elements 1 such as T-shaped bolts are inserted in the rear of the body (a) and the wall A2 and tightened with nuts 2 so that the body (a) is secured A pot-shaped portion a3 is provided in the front part of the equipment body (a). A water feed chamber a4 is formed in the upper section of the rear part of the body (a). A water drain passage a6 is formed at the bottom of the pot-shaped portion a3 so that the passage a6 obliquely extends up along the rear of the pot-shaped portion, is cranked halfway and communicates with a water drain port a5 opened in the rear of the equipment body (a).

A water feed port a7 is opened into the rear of the water feed chamber a4. The water feed port a7 is connected to a water feed pipe 3 which is embedded in the wall A2 and communicates with a water feeder (b). The water feed chamber a4 is connected through a communication hole a8 to a water passage a9 formed along the brim of the pot-shaped portion a3 and is also connected through a communication passage a10 to a water passage a11 formed under the water drain passage a6.

Numerous water ejection holes a12 are opened at appropriate intervals into the bottom of the water passage a9. A portion of washing water supplied from the water feeder (b) is discharged from the water ejection holes a12 on the inside surface of the post-shaped portion a3 to wash it.

The water passage a11 is provided with a first jet hole a13 at the bottom of a bent portion at the inlet port of the water drain passage a6 and with a second jet hole a14 above the first jet hole a13. The first and the second jet holes a13 and a14 are opened toward the outlet port of the water drain passage a6. Another portion of the washing water supplied from the water feeder is jetted from the jet holes a13 and a14 into the water drain passage a6 to send excrements together with accumulated water to the water drain port a5 to drain them to the exterior of the toilet through a water drain pipe 4 connected to the water drain port a5.

The water feeder (b) is made up of an electromagnetic flush valve, for example. The operation of the water feeder is controlled through an infrared sensor (c) provided on the wall a2. When it is detected by the sensor (c) that the user of the sanitary equipment has approached the body (a) of the equipment, a prescribed quantity of washing water is supplied to the water feed chamber a4. When the user has stood up after using the equipment, another quantity of washing water is supplied to the water feed chamber a4.

A toilet seat (d) made of synthetic resin or the like and shape similarly to the top of the equipment body (a) is integrally fitted on the top of body (a). An open portion d1 is provided in the front part of the toilet seat (d) so that the open portion d1 adjoins the pot-shaped portion a3. Air discharge passages d2 are formed in the right and left portions of the rear part of the toilet seat (d). A housing portion d3, in which an excretive organ washer 5 which ejects warm water to the excretive organ of the user of the sanitary equipment to wash the organ is provided, is formed in the center of the rear part of the toilet seat (d). A right and a left warm air passages d4 are formed between the housing portion d3 and the right and the left air discharge passage d2.

The front ends of the right and the left air discharge passages d2 are connected to a pair of right and left air discharge ports d5 opened in the bottom of the front of the open portion d1 toward the pot-shaped portion a3. Air discharge pipes 6, which communicate with the exterior of the toilet, are connected to the rear ends of the air discharge passage d2. An air discharge fan 7 is provided halfway in the air discharge pipes 6 to suck smelly air out of the pot-shaped portion a3 through the air discharge ports d5 and evacuate the smelly air to the exterior of the toilet through the air discharge passages d2 and the air discharge pipes 6. In this embodiment, the operation of the air discharge fan 7 is controlled through the sensor (c). When the user of the sanitary equipment has appropriated the body (a) of the equipment, the fan 7 is rotated. In a prescribed time after the user has moved away from the equipment body (a) after using the equipment the fan 7 is stopped.

The front ends of the right and the left warm air passages d4 are connected to a pair of right and left blowoff ports d6 opened in the rear of the open portion d1. The rear ends of the passages d4 are connected to air feed pipes 8 communicating with the interior or exterior of the toilet. An air feed fan 9, a heater 10 and an air filt 11 such as a sterilizing filter for removing dust or the like from to air and removing oxides or the like flying off from the surface of the heater 10 are sequentially provided halfway in the air feed pipes 8 so that the heater and the air filter are located downstream to the fan 9.

The air obtained from the interior or exterior of the toilet and heated by the heater 10 is blown off from the blowoff ports d6 to the user's excretive organ washed by the excretive organ washer 5, through the filter 11 by the air feed fan 9 to dry the excretive organ. The operation of the air feed fan 9 and the excretive organ washer 5 are regulated through a control panel 2 mounted on the wall A2.

Although the equipment body (a) is a blowout-type toilet stool in the above-mentioned embodiment, the equipment body (a) may be a toilet stool of any type.

Figure 5:
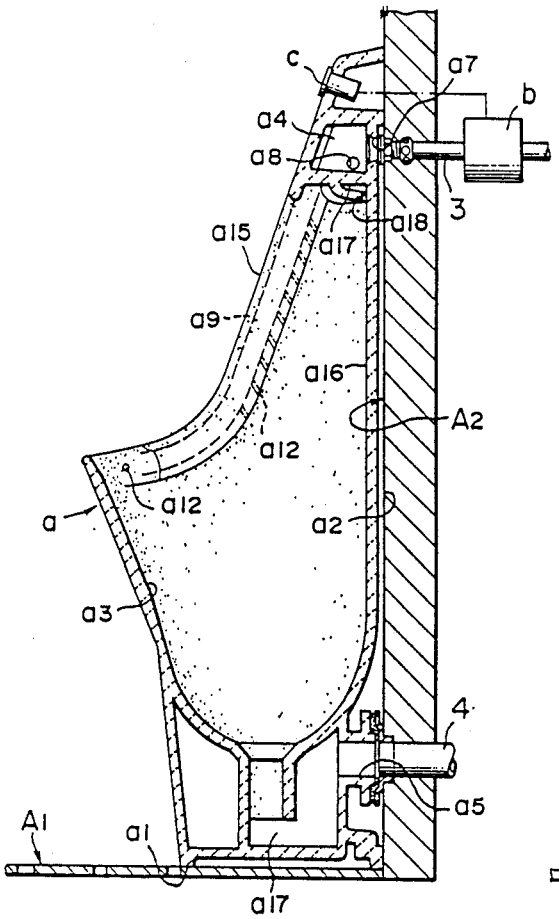
FIG. 5 shows a longitudinal sectional view of a sanitary equipment for a clean room, which is another embodiment of the present invention and whose body is toilet bowl for urine.
Figure 6:
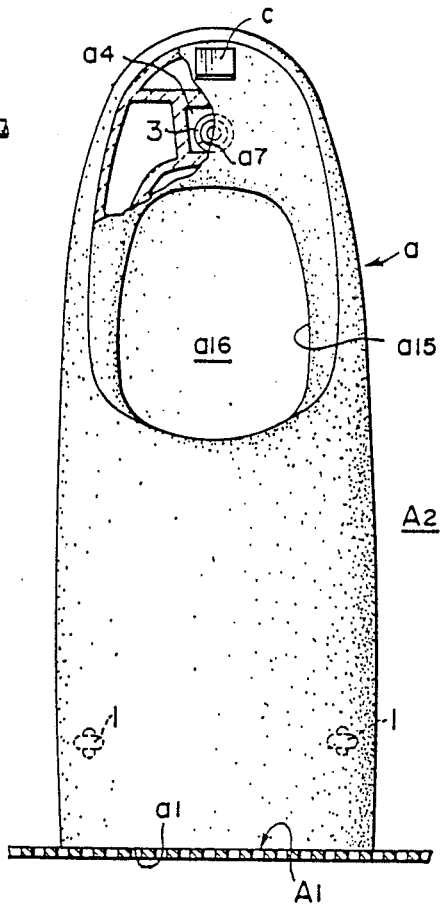
FIG. 6 shows a partially cutaway front view of the latter sanitary equipment.
Figure 7:
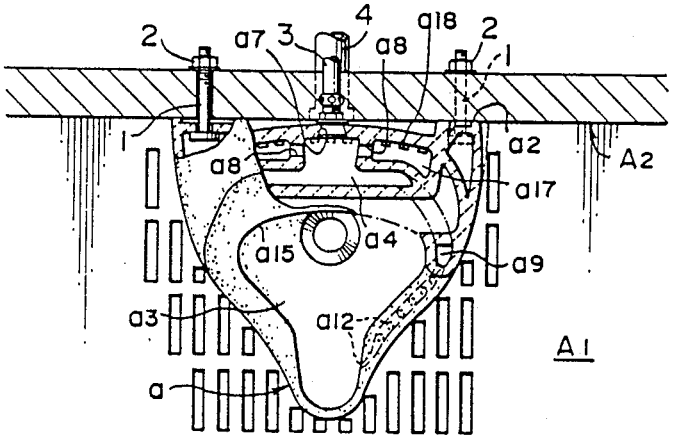
FIG. 7 shows a partially cutaway plan view of the latter sanitary equipment.

The embodiment shown in FIG. 5, 6 and 7 is hereinafter described. In this embodiment, the equipment body (a) is a toilet bowl for urine. The equipment body (a) is made of ceramic or synthetic resin so that the outside surface of the body (a) is almost vertical the upper part of the body is made slightly larger and larger downward, and the form of the body as seen from the front is similar to that of the longitudinal section of a bullet or bomb. The bottom a1 of the body (a) is placed on the floor A1 of a toilet. The rear a2 of the body (a) is made flat and put in tight contact with the wall A2 of the toilet. Fixation elements 1 such as T-shaped bolts are inserted in the rear a2 of the equipment body (a) and the wall A2 and tightened with nuts 2 so that the body (a) is secured.

An open portion a15 is provided in the upper section of the front part of the equipment body (a) so that the open portion a15 adjoins a pot-shaped portion a3. A water feed chamber a4 is formed over the pot-shaped portion a3 so that a rear wall a16 extends between the water feed chamber a4 and the pot-shaped portion a3. A water drain port a5 is opened into a trap a17 under the pot-shaped portion a3. A water drain pipe 4 embedded in the wall A2 is connected to the water drain port a5.

A water feed port a7 is opened into the rear of the water feed chamber a4. The water feed port a7 is connected to a water feed pipe 3 embedded in the wall A2 and communicating with a water feeder (b) such as an electromagnetic flush valve. Communication holes a8 are opened into the right and left portions of the rear of the water feed chamber a4 so that the holes a8 communicate with water spreading chambers a17 extending continuously to the bottom of the water feed chamber a4. The right and left portions of the front of the water feed chamber a4 communicate with water passages a9 formed along the brim of the open portion a15.

The operation of the water feeder (b) is controlled through a sensor (c) provided on the upper part of the front of the equipment body (a). In a prescribed time after it is detected by the sensor (c) that the user of the sanitary equipment has approached the body (a) of the equipment, a prescribed quantity of washing water is supplied to the water feed chamber a4 and then sent to the water spreading chambers a17 and the water passage a9.

Plural water spreading holes a18 are opened at appropriate intervals into the bottoms of the water spreading chambers a17 at the rear wall a16. A portion of the washing water introduced into the water feed chamber a4 through the water feed port a7 is discharged from the water spreading holes a18 on the inside surface of the rear wall a16.

Plural water ejection holes a12 are opened at appropriate intervals into the water passages a9 toward the pot-shaped portion a3. Another portion of the washing water introduced into the water feed chamber a4 is discharged from the water ejection holes a12 on the inside surface of the pot-shaped portion a3.

Figure 8:
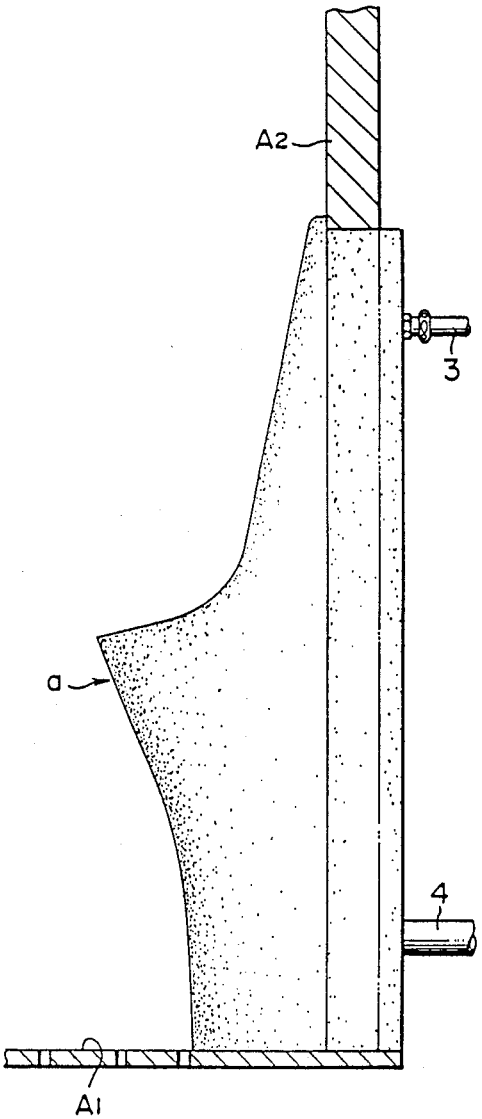
FIG. 8 shows a side view of a sanitary equipment for a clean room, which is still another embodiment of the present invention and whose body is a toilet bowl for urine.

FIG. 8 shows the other embodiment in which the rear a2 of the body (a) of a sanitary equipment is embedded in a wall A2.

Figure 9:
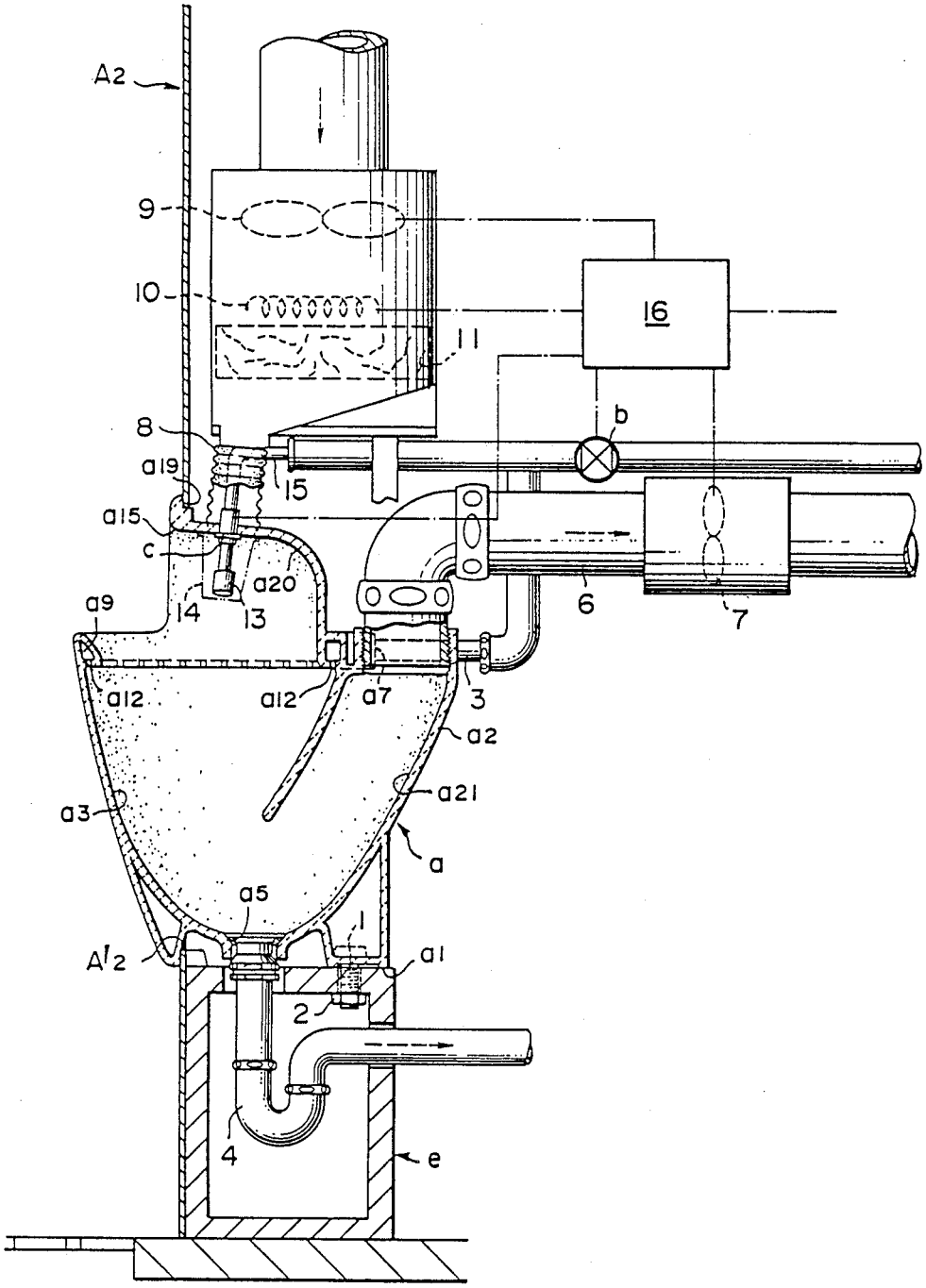
FIG. 9 shows a longitudinal sectional side view of a sanitary equipment for a clean room, which is still another embodiment of the present invention and whose body is a washstand.
Figure 10:
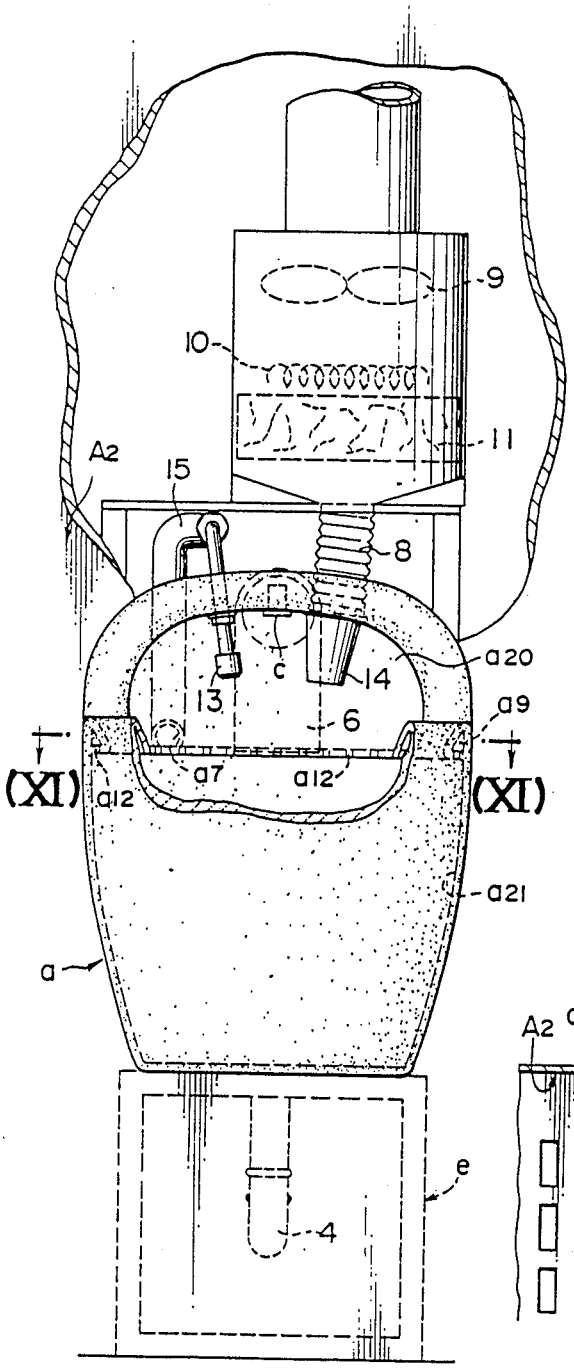
FIG. 10 shows a partially cutaway front view of the sanitary equipment whose body is the washstand.
Figure 11:
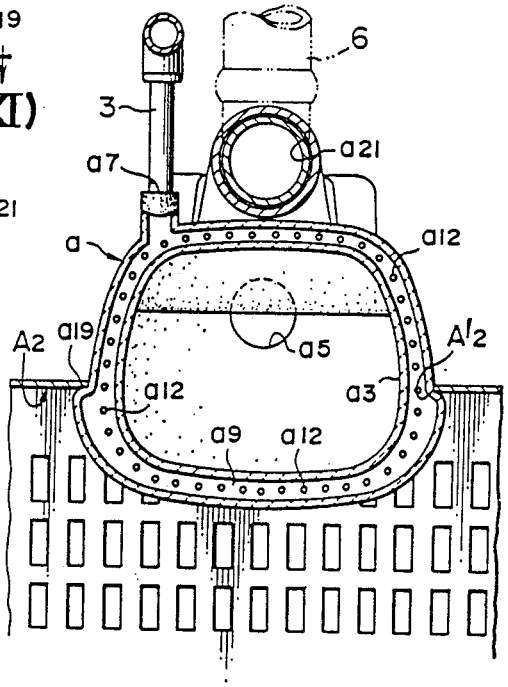
FIG. 11 shows a sectional view of the sanitary equipment along a line XI—XI shown in FIG. 10.

FIG. 9, 10 and 11 shows still another embodiment in which a washstand is provided as a sanitary equipment body (a). The body (a) is made of ceramic or synthetic resin so that the outside surface of the front of the body (a) is almost vertical or slightly oblique as shown in FIG. 9. The rear a2 of the equipment body (a) is embedded in a wall A2 so that an annular engaging stepped portion a19 vertically formed on the outer part of the body (a) is fitted, from the interior of a chamber furnished with the equipment, into a fitting hole A2' opened in the wall A2. The bottom a1 of the equipment body (a) is placed on a pedestal (e) located outside the chamber. A fixation element 1 such as a bolt is inserted in the bottom a1 and the pedestal (e) and tightened with a nut 2 so that the body (a) is secured.

An open portion a15 is provided in the upper part of the front of the equipment body (a) so that the open portion adjoins a pot-shaped portion a3. A dome-shaped cover a20 is formed on the upper part of the rear of the body (a) so that the cover a20 extends over the rear part of the pot-shaped portion a3. A water passage a9 is formed at the brim of the pot-shaped portion a3 along the total circumference thereof.

When the equipment body (a) is secured, the upper edge of the open portion a15 is made nearly flush with the surface of the wall A2 so that only the front of the pot-shaped portion a3 project from the wall A2.

A feed port a7 is opened into the rear of the water passage a9 so that a water feed pipe 3 communicating with a water feeder (b) such as a solenoid valve is connected to the water feed port a7. Numerous water ejection holes a12 are opened at appropriate intervals into the bottom of the water passage a9. Washing water supplied from the water feeder (b) is discharged from the water ejection holes a12 on the inside surface of the pot-shaped portion a3 to make a water film to wash hands.

A water drain port a5 is opened in the bottom of the pot-shaped portion a3 so that a water drain pipe 4 is connected to the water drain port a5. The diameter of the drain port a5 is made such that no water accumulates at the bottom of the inside of the pot-shaped portion a3 even if the maximum quantity of washing water is discharged from a water ejector 13 mentioned below. The inlet port of an air discharge passage a21 is opened above the water drain port a5 and beside (behind as to FIG. 9) it.

The air discharge passage a21 obliquely extends up from said inlet port along the rear of the pot-shaped portion a3. An air dischar pipe 6, which communicates with the exterior of the chamber furnished with the sanitary equipment, is connected to the outlet port of the air discharge passage a21. An air discharge fan 7 is provided in the halfway portion of the air discharge pipe 6.

When the air discharge fan 7 is rotated, the air in the pot-shaped portion a3 is sucked out of it through the inlet port of the air discharge port a21, turned as U along the bottom of the inside surface of the pot-shaped portion and evacuated to the exterior of the chamber through the air discharge pipe 6. In this embodiment, the operation of the air discharge fan 7 is controlled through a sensor (c) mentioned below, so that the quantity of the air discharged by the fan is changed in a prescribed time after the start of the operation. In other words, the rotational frequency of the air discharge fan 7 is low while the washing water is discharged from the water ejector 13; and the rotational frequency of the fan is heightened to increase the quantity of the sucked air when hot air is blown off from a blowoff port 14 mentioned below.

The water ejector 13 for washing the hands of the user of the sanitary equipment, the blowoff port 14 for drying the already washed hands and the sensor (c) for control both the washing and the drying are provided through the cover a20.

A water ejection pipe 15 ramified from the secondary side of the water feeder (b) for supplying the washing water to the water passage a9 connected to the upper end of the water ejector 13. The lower end of the ejector 13 is protruded in the over a20 so that the drops of the washing water supplied from the water feeder (b ) do not fly out of the equipment body (a).

A air feed pipe 8 is connected to the blowoff port 14. An air feed fan 9 is provided in the halfway portion of the air feed pipe 8 so that the air inside or outside the chamber furnished with the sanitary equipment is rapidly blown off from the port 14. A heater 10 and an air filter 11 such as a sterilizing filter for removing dust or the like from the air and removing oxides or the like flying off from the surface of the heater are sequentially provided downstream to the air feed fan 9.

The sensor (c) is a conventional photoelectric infrared sensor which sends a detection signal to a controller 16 when the user of the sanitary equipment has inserted his hand into the pot-shaped portion a3 through the open portion a15.

The controller 16 is electrically connected to the water feeder (b), the air discharge fan 7, the sensor (c), the air feed fan 9 and the heater 10. When the detection signal is sent from the sensor (c) to the controller 16, the water feeder (b) is opened and the air discharge fan 7 is rotated at the low rotational frequency for 10 to 15 seconds, for example. After that, electricity is applied to the heater 10 to cause it to heat, the air feed fan 9 is rotated and the air discharges fan 7 is rotated at the heightened rotational frequency, for 30 seconds to 1 minute, for example.

When the user of the washstand has inserted his hands into the pot-shaped portion a3 through the open portion a15, washing water is discharged from the ejection holes a12 of the water passage a9 to make a water film on the inside surface of the pot-shaped portion, other washing water is jetted as a shower bath from the water ejector 13 to wash the hands of the user, and the air in the pot-shaped portion is evacuated out of it. When the discharge and the jetting of the washing water and the evacuation of the air are stopped, hot air is rapidly blown off from the blowoff port 14 to remove water drops from the hands to dry them, and the quantity of the air sucked through the air discharge passage a21 is increased to suck dust or the like flying off from the hand-washing user and his clothes, to evacuate the air and the dust or the like to the exterior of the chamber furnished with the sanitary equipment.

Although the quantity of the air sucked by the air discharge fan 7 is changed in a prescribed time in the above-mentioned embodiment, the rotation of the fan 7 may be started at the same time as the blowoff of the hot air from the blowoff port 14.

We claim:

1. Sanitary equipment used for hand washing and being disposed for use in a sanitary equipment installation composed of a chamber having sides including at least one wall and a floor, said sanitary equipment comprising:

(a) an equipment body having a substantially vertical front portion and a rear portion;

(b) means for attaching said equipment body to a wall of said chamber so that said rear portion is embedded in said wall, said means for attaching not projecting into said chamber;

(c) means for forming an open portion in an upper part of said equipment body about said front portion of said equipment body , said open portion having an opening which opens into said chamber, and which provides access to a pot-shaped portion in a lower part of said equipment body, said means for forming an open portion extending towards said rear portion and said pot-shaped portion;

(d) said means for forming an open portion including a first engaging portion and said front portion including a second engaging portion, said first engaging portion and second engaging portion enganging the side of said wall facing said chamber when said rear portion of said equipment body is embedded in said wall, wherein only said substantially vertical front portion said open portion and said first and second engaging portions are housed in the chamber, thereby allowing laminar flow of air in the chamber relative to the sanitary equipment to substantially prevent dust from adhering to the sanitary equipment.

2. The sanitary equipment according to claim 1, wherein said equipment body comprises a washstand.

3. The sanitary equipment according to claim 1, wherein said equipment body further comprises:

(i) a water feeder for supplying water to said equipment body; and (ii) a sensor for automatically opening and closing said water feeder at appropriate times responsive to actions of a user of said sanitary equipment.

4. The sanitary equipment according to claim 3 wherein said sensor comprises an infrared sensor.

5. The sanitary equipment according to claim 3 wherein said equipment body is a washstand, said washstand further comprising:

(i) said water feeder supplying water to said washstand through a water ejector;

(ii) an air discharge fan for sucking air out of said chamber;

(iii) a blowoff port for ejecting warm air to dry the hands of said user;

(iv) a heater for heating said warm air;

(v) an air feed fan for blowing said warm air through said blowoff port; and (vi) a controller electrically connected to said water feeder, said air discharge fan, said sensor, said heater and said air feed fan, for controlling said water feeder, said air discharge fan, said heater and said air feed fan in response to said sensor.

6. The sanitary equipment according to claim 3, said pot-shaped portion including a brim at the upper portion thereof, and a water passage being located at said brim.

7. The sanitary equipment according to claim 1, wherein said means for forming an open portion is a cover extending over said pot-shaped portion.

8. The sanitary equipment according to claim 1, said open portion including an upper edge, said upper edge being substantially flush with the surface of said wall.

* * * * *

UNITED STATES PATENT AND TRADEMARK OFFICE

CERTIFICATE OF CORRECTION

PATENT NO. : 4,967,425

DATED : November 6, 1990

INVENTOR(S) : S. KAWAMURA et al.

It is certified that error appears in the above-identified patent and that said Letters Patent is hereby corrected as shown below:

On column 1, line 10, change "sttached" to ---attached---.
On column 1, line 36, change "in stead" to ---instead---.
On column 1, line 58, change "cuase" to ---cause---.
On column 2, line 21, after "is" insert ---a---.
On column 2, line 50, change "toilet as" to ---toilet. As---.
On column 4, line 8, change "filt" to ---filter---.
On column 5, line 45, change "project" to ---projects---.
On column 5, line 68, change "dischar" to ---discharge---.
On column 6, line 29, after "a9" insert ---is---.
On column 6, line 31, change "over" to ---cover---.
On column 6, line 56, change "discharges" to ---discharge---.
On column 7, line 26 (claim 1, line 13), change "about" to ---above---.
On column 7, line 36 (claim 1, line 23), change "enganging" to ---engaging---.

Signed and Sealed this

Seventeenth Day of August, 1993

Bruce Lehman

*Attest:*

BRUCE LEHMAN

*Attesting Officer*

*Commissioner of Patents and Trademarks*